US010286933B2

(12) United States Patent
Luo et al.

(10) Patent No.: US 10,286,933 B2
(45) Date of Patent: May 14, 2019

(54) HONEYCOMB TYPE COWCATCHER AND ENERGY ABSORBER FOR RAIL TRANSIT VEHICLES

(71) Applicant: SHENZHEN CANSINGA TECHNOLOGY CO., LTD, Shenzhen (CN)

(72) Inventors: Changjie Luo, Shenzhen (CN); Wenze Yu, Shenzhen (CN); Zhaojing Liu, Shenzhen (CN); Shun Hu, Shenzhen (CN)

(73) Assignee: SHENZHEN CANSINGA TECHNOLOGY CO., LTD, Shenzhen (CN)

( * ) Notice: Subject to any disclaimer, the term of this patent is extended or adjusted under 35 U.S.C. 154(b) by 73 days.

(21) Appl. No.: 15/549,563

(22) PCT Filed: Jun. 13, 2016

(86) PCT No.: PCT/CN2016/085560
§ 371 (c)(1),
(2) Date: Aug. 8, 2017

(87) PCT Pub. No.: WO2017/166436
PCT Pub. Date: Oct. 5, 2017

(65) Prior Publication Data

US 2017/0341664 A1 Nov. 30, 2017

(30) Foreign Application Priority Data

Mar. 29, 2016 (CN) ..... 2016 1 01866161

(51) Int. Cl.
*B61F 19/04* (2006.01)

(52) U.S. Cl.
CPC ..... *B61F 19/04* (2013.01)

(58) Field of Classification Search
CPC ..... B61F 19/04
(Continued)

(56) References Cited

U.S. PATENT DOCUMENTS 3,744,835 A * 7/1973 Carbone ..... B60R 19/18 188/377
3,888,531 A * 6/1975 Straza ..... B60R 19/18 188/376
(Continued)

FOREIGN PATENT DOCUMENTS

CN 201511970 U 6/2010
CN 152514588 A 6/2012
(Continued)

OTHER PUBLICATIONS

The World Intellectual Property Organization (WIPO) International Search Report for PCT/CN2016/085560 dated Dec. 28, 2016 12 Pages.

*Primary Examiner* — Jason C Smith
(74) *Attorney, Agent, or Firm* — Anova Law Group, PLLC

(57) ABSTRACT

The present invention discloses a honeycomb type cowcatcher and energy absorber for rail transit vehicles, comprising a high rigidity supporting back frame for cowcatcher and energy absorber, arranged detachably on a frame body of rail transit vehicle; at least one honeycomb type cowcatcher and energy absorber unit fixedly screwed on supporting back frame, applied to absorbing an impact energy generated by collision through plastic deformation; the honeycomb type unit comprises honeycomb structured accommodation cavity, where a honeycomb structure arranged. Through a method of mounting a honeycomb type unit onto the high rigidity supporting back frame, the present invention makes part of energy have been absorbed by the unit before a rigid collision between obstacle and train body
(Continued)

happens, thus weakens a relatively large impact afforded by train body, therefore, decreases a damage from obstacle to train body.

7 Claims, 3 Drawing Sheets

(58) Field of Classification Search
USPC ..... 105/392.5
See application file for complete search history.

(56) References Cited

U.S. PATENT DOCUMENTS

| | | | | | |
|---|---|---|---|---|---|
| 5,462,144 | A * | 10/1995 | Guardiola | B61F 1/08 | 105/416 |
| 2009/0058109 | A1* | 3/2009 | Mattschull | B60R 19/14 | 293/102 |
| 2014/0033949 | A1* | 2/2014 | Prockat | B61D 17/041 | 105/392.5 |
| 2017/0341664 | A1* | 11/2017 | Luo | B61F 19/04 | |

FOREIGN PATENT DOCUMENTS

| | | | |
|---|---|---|---|
| CN | 103303334 | A | 9/2013 |
| CN | 105599781 | A | 5/2016 |
| CN | 205524285 | U | 8/2016 |
| JP | H06211133 | A | 8/1994 |
| JP | H07290618 | A | 11/1995 |
| KR | 1020140055232 | A | 5/2014 |

* cited by examiner

HONEYCOMB TYPE COWCATCHER AND ENERGY ABSORBER FOR RAIL TRANSIT VEHICLES

CROSS-REFERENCES TO RELATED APPLICATIONS

This application is a national stage application of PCT Patent Application No. PCT/CN 2016/085560, filed on Jun. 13, 2016, which claims priority to Chinese Patent Application No. 2016101866161, filed on Mar. 29, 2016, the content of all of which is incorporated herein by reference.

FIELD OF THE INVENTION

The present invention relates to the field of buffering and energy-absorption device technology, and, more particularly, to a honeycomb type cowcatcher and energy absorber for rail transit vehicles.

BACKGROUND

With a rapid development of rail transit, a running speed of a train is faster and faster, at a same time of getting a more convenient travel, a harm caused by an accident is also heavier and heavier, especially when the train is running on an open rail in a country field, due to a lack of fence protection, a plurality of wild animals may go to the rail at any time, especially the wild animals with a relatively large body, such as a wild boar, a wild dog or else, which may cause a great threat to a safe running of the train. Therefore, at a same time of improving a reliability of an active control, a passive security and protection is also more and more important. In order to relieve a huge damage to a body structure of the train caused by a collision between a rail transit vehicle and an obstacle, usually a cowcatcher is arranged on each of both front and back ends of the train.

The cowcatcher of a rail vehicle, in a traditional format, commonly adopts a structural format of steel plate welding, such a cowcatcher usually has a pretty high rigidity on structure, at a collision, an impact will be transferred directly to an underframe of the train, which owns a very huge peak value during the collision instantaneously, and once it exceeds a yield limit of a body material of the vehicle, an irreparable damage to the train body will be generated, which may not only fail to remove the obstacle, but also cause the cowcatcher fall off during the collision.

There is also a retractable style cowcatcher, including a flange and an energy absorption tube being able to deform under a radial pressure, whose work principle is, when the retractable style cowcatcher hits an obstacle, the energy absorption tube moves back axially, and deforms radically under the pressure to absorb the energy of impaction. On one hand, two retractable style cowcatchers are arranged at each of both front and back ends of the train, right above the rails, which owns a relatively small range of energy absorption, may only clean obstacles in small sizes, and follow an axial direction; on an other hand, the retractable style cowcatcher needs to move backwards during working, thus, it is needed to preserve a certain room at the back end, which wastes a space structure.

Therefore, the current technology needs to be improved and developed.

BRIEF SUMMARY OF THE DISCLOSURE

According to the above described defects, the purpose of the present invention is providing a honeycomb type cowcatcher and energy absorber for rail transit vehicles, in order to solve the defects in the prior arts that the cowcatcher with a single rigid plate structure owns a low impact resistance, while the retractable style cowcatcher in a single style owns the defect of a small obstacle removing range.

In order to achieve the above mentioned goals, the technical solution of the present invention to solve the technical problems is as follows:

A honeycomb type cowcatcher and energy absorber for rail transit vehicles, wherein, it comprises:

a high rigidity supporting back frame for the cowcatcher and energy absorber, the high rigidity supporting back frame for the cowcatcher and energy absorber is mounted detachably on a frame body of the rail transit vehicle;

at least one honeycomb type cowcatcher and energy absorber unit, the honeycomb type cowcatcher and energy absorber unit is fixedly screwed on the high rigidity supporting back frame for the cowcatcher and energy absorber, applied to absorbing an impact energy generated by the collision through a plastic deformation;

the honeycomb type cowcatcher and energy absorber unit comprises a honeycomb structured accommodation cavity, and a honeycomb structure arranged in the honeycomb structured accommodation cavity.

The honeycomb type cowcatcher and energy absorber for rail transit vehicles, wherein, the high rigidity supporting back frame for the cowcatcher and energy absorber comprises a fixing supporter, and an obstacle removing plate arranged fixedly on the fixing supporter.

The honeycomb type cowcatcher and energy absorber for rail transit vehicles, wherein, the honeycomb structured accommodation cavity comprises a skin, the skin is arranged around the honeycomb structure, with an opening on either end of the skin; it further comprises a rear protection board, arranged fixedly at a first opening of the skin near an end of the high rigidity supporting back frame for the cowcatcher and energy absorber while adapting to the first opening, the rear protection board is fixedly arranged on the obstacle removing plate; it further comprises a front protection board, arranged fixedly at a second opening of the skin away from the end of the high rigidity supporting back frame for the cowcatcher and energy absorber while adapting to the second opening.

The honeycomb type cowcatcher and energy absorber for rail transit vehicles, wherein, one end of the high rigidity supporting back frame for the cowcatcher and energy absorber has a first honeycomb type unit for the cowcatcher and energy absorber arranged, another end of the high rigidity supporting back frame for the cowcatcher and energy absorber has a second honeycomb type unit for the cowcatcher and energy absorber arranged symmetrically.

The honeycomb type cowcatcher and energy absorber for rail transit vehicles, wherein, an angle between the first honeycomb type unit for the cowcatcher and energy absorber and the second honeycomb type unit for the cowcatcher and energy absorber is 0-180 degrees.

The honeycomb type cowcatcher and energy absorber for rail transit vehicles, wherein, a material of the obstacle removing plate is aluminum, stainless steel, magnesium or beryllium copper.

The honeycomb type cowcatcher and energy absorber for rail transit vehicles, wherein, the honeycomb structure is a hexagonal honeycomb core or aluminum foam.

The present invention provides a honeycomb type cowcatcher and energy absorber for rail transit vehicles, which comprises a high rigidity supporting back frame for the cowcatcher and energy absorber, the high rigidity supporting back frame for the cowcatcher and energy absorber is arranged detachably on a frame body of the rail transit vehicle; at least one honeycomb type cowcatcher and energy absorber unit, the honeycomb type cowcatcher and energy absorber unit is fixedly screwed on the high rigidity supporting back frame for the cowcatcher and energy absorber, applied to absorbing an impact energy generated by the collision through a plastic deformation; the honeycomb type cowcatcher and energy absorber unit comprises a honeycomb structured accommodation cavity, and a honeycomb structure arranged in the honeycomb structured accommodation cavity. Through a method of mounting a honeycomb type cowcatcher and energy absorber unit onto the high rigidity supporting back frame for the cowcatcher and energy absorber, the present invention makes part of the energy have already been absorbed by the honeycomb type cowcatcher and energy absorber unit before a rigid collision between the obstacle and the train body happens, thus weakens a relatively large impact afforded by the train body, therefore, decreases a damage from the obstacle to the train body.

DETAILED DESCRIPTION OF EMBODIMENTS

The present invention provides a honeycomb type cowcatcher and energy absorber for a rail transit vehicle, in order to make the purpose, technical solution and the advantages of the present invention clearer and more explicit, further detailed descriptions of the present invention are stated here, referencing to the attached drawings and some preferred embodiments of the present invention. It should be understood that the detailed embodiments of the invention described here are used to explain the present invention only, instead of limiting the present invention.

Figure 1:
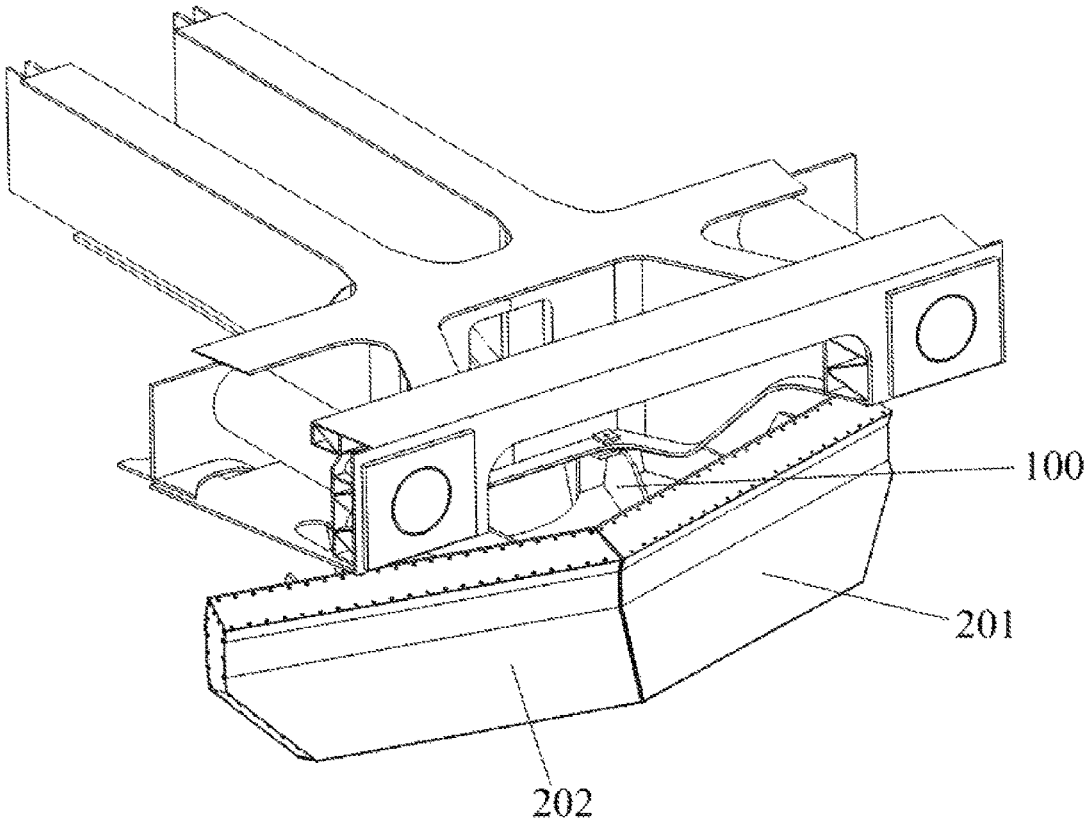
FIG. 1 illustrates a schematic diagram of a honeycomb type cowcatcher and energy absorber for rail transit vehicles mounting on a train body of a rail transit vehicle as provided by the present invention.
Figure 2:
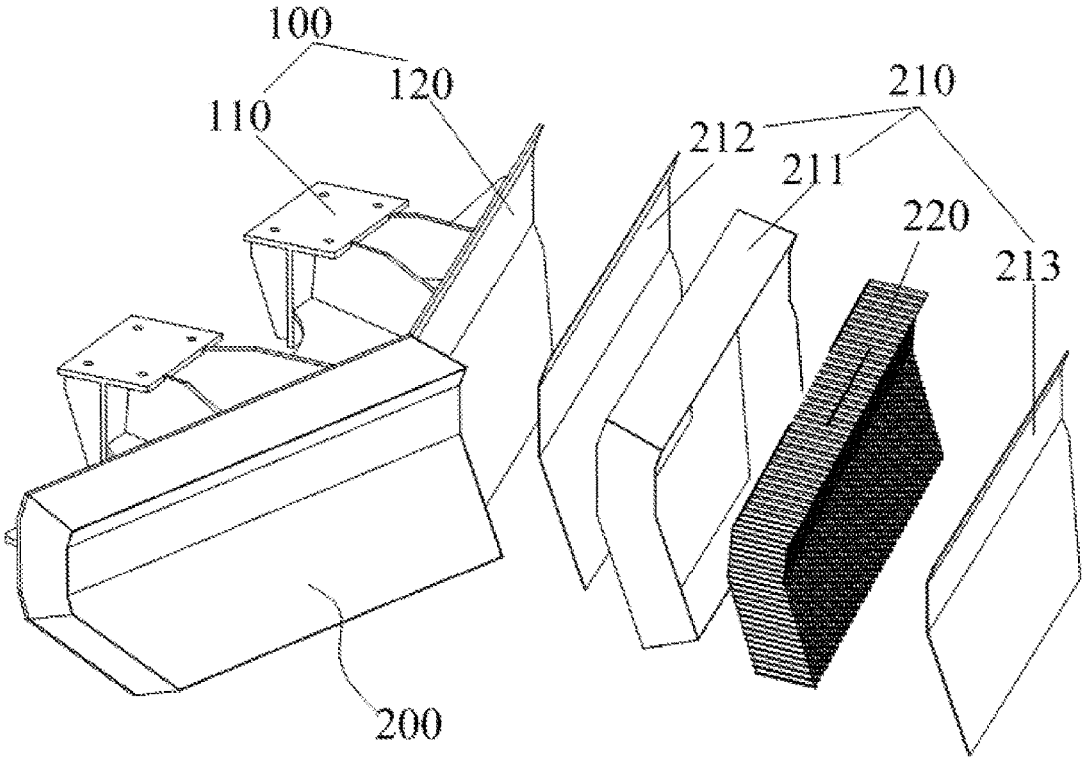
FIG. 2 illustrates a local explosion diagram of the honeycomb type cowcatcher and energy absorber for rail transit vehicles as described in the present invention.
Figure 3:
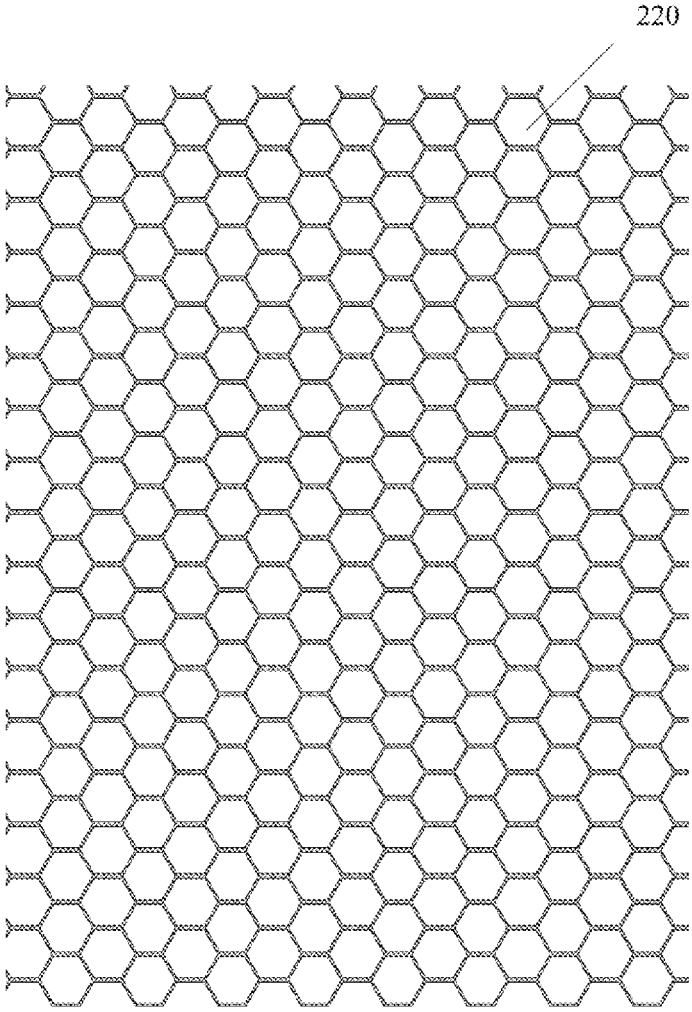
FIG. 3 illustrates a schematic diagram of a preferred embodiment of the honeycomb structure in the honeycomb type cowcatcher and energy absorber for rail transit vehicles as described in the present invention.

Referencing to FIG. 1 and FIG. 2 together, wherein, FIG. 1 illustrates a schematic diagram of a honeycomb type cowcatcher and energy absorber for rail transit vehicles mounting on a train body of a rail transit vehicle as provided by the present invention, FIG. 2 illustrates a local explosion diagram of the honeycomb type cowcatcher and energy absorber for rail transit vehicles as described in the present invention. FIG. 3 illustrates a schematic diagram of a preferred embodiment of the honeycomb structure in the honeycomb type cowcatcher and energy absorber for rail transit vehicles as described in the present invention. As shown in FIG. 1-FIG. 3, the honeycomb type cowcatcher and energy absorber for rail transit vehicles comprises:

a high rigidity supporting back frame for the cowcatcher and energy absorber 100, the high rigidity supporting back frame for the cowcatcher and energy absorber 100 is arranged detachably on a frame body of the rail transit vehicle;

at least one honeycomb type cowcatcher and energy absorber unit 200, the honeycomb type cowcatcher and energy absorber unit 200 is fixedly screwed on the high rigidity supporting back frame for the cowcatcher and energy absorber 100, applied to absorbing an impact energy generated by the collision through a plastic deformation;

the honeycomb type cowcatcher and energy absorber unit 200 comprises a honeycomb structured accommodation cavity 210, and a honeycomb structure 220 arranged in the honeycomb structured accommodation cavity 210.

In the embodiments of the present invention, through a method of mounting a honeycomb type cowcatcher and energy absorber unit 200 before an obstacle removing board of a traditional cowcatcher, the present invention makes an impact energy generated during a train collision transfer into a deformation energy of the honeycomb material following a direction of the collision and an elastic deformation energy of both the train body and a rigid plate, before a rigid collision between the obstacle and the train body happens, and absorbs part of the energy in such a way, thus weakens a relatively large impact afforded by the train body, therefore, decreases a damage from the obstacle to the train body. Also, the obstacle may be pushed out of a range of the rail on which the train is running, and avoid the obstacle entering into a bottom of the train body before causing a second accident, that is, the honeycomb type cowcatcher and energy absorber for rail transit vehicles owns both an obstacle removing function as the traditional cowcatcher and a bumping energy absorption function.

The honeycomb type cowcatcher and energy absorber for rail transit vehicles described in the present invention, may not only improve an obstacle removing ability of the traditional cowcatcher, but also decrease a weight of the obstacle removing plate in a traditional cowcatcher, also, the honeycomb type cowcatcher and energy absorber unit 200 may be replaced rapidly after a damage of collision, it owns a simple structure, it is reliable and low-cost, may be manufactured in a batch. The honeycomb type cowcatcher and energy absorber for rail transit vehicles owns an outstanding obstacle removing feather and energy absorption ability; especially when a large or medium obstacle hits the rail vehicle, it may protect the train body structure and a safety of train personnel.

In a real implement, referencing to FIG. 2, the high rigidity supporting back frame for the cowcatcher and energy absorber 100 comprises a fixing supporter 110, and an obstacle removing plate 120 arranged fixedly on the fixing supporter 110. When the high rigidity supporting back frame for the cowcatcher and energy absorber 100 is mounted onto a train body of a rail transit vehicle, it was not totally vertical to a direction of the ground, but there is a certain tilt angle. Through a structural design of the tilt obstacle removing plate, at a same time of absorbing the impact energy, the obstacle may be cleaned out of a range of the rail in a very short time.

Referencing to FIG. 2 again, the honeycomb structured accommodation cavity 210 comprises a skin 211, the skin 211 is arranged around the honeycomb structure 220, with an opening on either end of the skin 211; it further comprises a rear protection board 212, arranged fixedly at a first opening (not showing in the FIG.) of the skin 211 near an end of the high rigidity supporting back frame for the cowcatcher and energy absorber and adapting to the first opening, the rear protection board 212 is fixedly arranged on the obstacle removing plate 120; it further comprises a front protection board 213, arranged fixedly at a second opening of the skin 211 away from the end of the high rigidity supporting back frame for the cowcatcher and energy absorber and adapting to the second opening. Thus, it can be seen that, the skin 211, the rear protection board 212 and the front protection board 213 are surrounding into a box-like shape, and loading the honeycomb structure 220 into the honeycomb structured accommodation cavity 210 formed, in such a way, when the honeycomb type cowcatcher and energy absorber unit 200 is damaged after a collision, the protection board 213 may be opened for a rapid replacement.

As a preferred embodiment of the present invention, shown as FIG. 1, one end of the high rigidity supporting back frame for the cowcatcher and energy absorber 100 has a first honeycomb type unit for the cowcatcher and energy absorber 201 arranged, another end of the high rigidity supporting back frame for the cowcatcher and energy absorber has a second honeycomb type unit for the cowcatcher and energy absorber 202 arranged symmetrically. An angle between the first honeycomb type unit for the cowcatcher and energy absorber 201 and the second honeycomb type unit for the cowcatcher and energy absorber 202 is 0-180 degrees.

In a real implement, referencing to FIG. 3, the honeycomb structure 220 is a hexagonal honeycomb core. The hexagonal honeycomb core is only one of the embodiments of the honeycomb structure 220. The honeycomb structure 220 is not limited to a hexagonal shape of hole, it may also be a rectangular shape or a round shape of hole. The material that the honeycomb structure 220 adopts is not limited to a pointed metal material, materials including aluminum, stainless steel, magnesium beryllium copper and else may also be adopted. The honeycomb structure 220 is also not limited to a honeycomb core, it may also adopt a foam aluminum or else. The material of the obstacle removing plate 120 is not limited to a pointed metal material; other materials including aluminum, stainless steel, magnesium, beryllium copper may also be adopted All above, the present invention discloses a honeycomb type cowcatcher and energy absorber for rail transit vehicles, which comprises a high rigidity supporting back frame for the cowcatcher and energy absorber, the high rigidity supporting back frame for the cowcatcher and energy absorber is arranged detachably on a frame body of the rail transit vehicle; at least one honeycomb type cowcatcher and energy absorber unit, the honeycomb type cowcatcher and energy absorber unit is fixedly screwed on the high rigidity supporting back frame for the cowcatcher and energy absorber, applied to absorbing an impact energy generated by the collision through a plastic deformation; the honeycomb type cowcatcher and energy absorber unit comprises a honeycomb structured accommodation cavity, and a honeycomb structure arranged in the honeycomb structured accommodation cavity. Through a method of mounting a honeycomb type cowcatcher and energy absorber unit onto the high rigidity supporting back frame for the cowcatcher and energy absorber, the present invention makes part of the energy have already been absorbed by the honeycomb type cowcatcher and energy absorber unit before a rigid collision between the obstacle and the train body happens, thus weakens a relatively large impact afforded by the train body, therefore, decreases a damage from the obstacle to the train body.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. A honeycomb type cowcatcher and energy absorber for rail transit vehicles, comprising:

a high rigidity supporting back frame for the cowcatcher and energy absorber, the high rigidity supporting back frame for the cowcatcher and energy absorber is mounted detachably on a frame body of the rail transit vehicle; and at least one honeycomb type cowcatcher and energy absorber unit, the honeycomb type cowcatcher and energy absorber unit is fixedly screwed on the high rigidity supporting back frame for the cowcatcher and energy absorber, applied to absorbing an impact energy generated by the collision through a plastic deformation;

wherein:

the honeycomb type cowcatcher and energy absorber unit comprise a honeycomb structured accommodation cavity, and a honeycomb structure arranged in the honeycomb structured accommodation cavity;

the high rigidity supporting back frame for the cowcatcher and energy absorber comprises a fixing supporter, and an obstacle removing plate arranged between the fixing supporter and the honeycomb type cowcatcher and energy absorber unit; and the obstacle removing plate is fixed with a tilt angle with the ground without being vertical to the ground.

2. The honeycomb type cowcatcher and energy absorber for rail transit vehicles according to claim 1, wherein the honeycomb structured accommodation cavity comprises a skin, the skin is arranged around the honeycomb structure, with an opening on either end of the skin; it further comprises a rear protection board, arranged fixedly at a first opening of the skin near an end of the high rigidity supporting back frame for the cowcatcher and energy absorber while adapting to the first opening, the rear protection board is fixedly arranged on the obstacle removing plate; it further comprises a front protection board, arranged fixedly at a second opening of the skin away from the end of the high rigidity supporting back frame for the cowcatcher and energy absorber while adapting to the second opening.

3. The honeycomb type cowcatcher and energy absorber for rail transit vehicles according to claim 2, wherein one end of the high rigidity supporting back frame for the cowcatcher and energy absorber has a first honeycomb type unit for the cowcatcher and energy absorber arranged, another end of the high rigidity supporting back frame for the cowcatcher and energy absorber has a second honeycomb type unit for the cowcatcher and energy absorber arranged symmetrically.

4. The honeycomb type cowcatcher and energy absorber for rail transit vehicles according to claim 3, wherein an angle between the first honeycomb type unit for the cowcatcher and energy absorber and the second honeycomb type unit for the cowcatcher and energy absorber is 0-180 degrees.

5. The honeycomb type cowcatcher and energy absorber for rail transit vehicles according to claim 1, wherein a material of the obstacle removing plate is aluminum, stainless steel, magnesium or beryllium copper.

6. The honeycomb type cowcatcher and energy absorber for rail transit vehicles according to claim 1, wherein the honeycomb structure is a hexagonal honeycomb core or aluminum foam.

7. The honeycomb type cowcatcher and energy absorber for rail transit vehicles according to claim 1, wherein the honeycomb structure comprises a plurality of honeycomb structure sidewalls and forms a plurality of honeycomb hollows, an axis of the plurality of honeycomb hollows is parallel to the ground.

* * * * *